US008064791B2

(12) United States Patent
Imaizumi

(10) Patent No.: US 8,064,791 B2
(45) Date of Patent: Nov. 22, 2011

(54) CHARGING DEVICE FOR ELECTRICALLY CHARGING PHOTOSENSITIVE MEMBER

(75) Inventor: Kei Imaizumi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 12/749,745

(22) Filed: Mar. 30, 2010

(65) Prior Publication Data

US 2010/0247135 A1 Sep. 30, 2010

(30) Foreign Application Priority Data

Mar. 31, 2009 (JP) ..... 2009-086515
Mar. 15, 2010 (JP) ..... 2010-056887

(51) Int. Cl.
*G03G 15/02* (2006.01)

(52) U.S. Cl. ..... 399/100; 399/115

(58) Field of Classification Search ..... 399/98–100, 399/107, 110, 115, 168, 174–176
See application file for complete search history.

(56) References Cited

U.S. PATENT DOCUMENTS 7,139,512 B2 * 11/2006 Namiki et al. ..... 399/176
7,471,924 B2 * 12/2008 Shigezaki et al. ..... 399/349
7,664,433 B2 * 2/2010 Fujita et al. ..... 399/174

FOREIGN PATENT DOCUMENTS

JP 2006-276134 10/2006

* cited by examiner

*Primary Examiner* — Hoan Tran
(74) *Attorney, Agent, or Firm* — Fitzpatrick, Cella, Harper & Scinto

(57) ABSTRACT

A charging device includes a rotatable charging member for electrically charging a photosensitive member; and a brush, rotating along a rotational direction of the charging member by contacting the charging member to receive a force, including fibers for cleaning the charging member. The fibers have been subjected to fiber-tilting treatment so that the fibers are tilted in a direction counterdirectionally with a rotational direction of the brush.

5 Claims, 5 Drawing Sheets

CHARGING DEVICE FOR ELECTRICALLY CHARGING PHOTOSENSITIVE MEMBER

FIELD OF THE INVENTION AND RELATED ART

The present invention relates to a charging device including a charging member for electrically charging a photosensitive member and a brush for cleaning the charging member. More specifically, the present invention relates to a constitution of the brush, rotating by rotation of the charging member, for cleaning the charging member.

An image forming apparatus in which the charging member is brought into contact with the photosensitive member to electrically charge the photosensitive member and then a toner image is formed on the photosensitive member through exposure and development has been used widely. Generally, the charging member includes a metal center shaft member and an elastic member of an electroconductive rubber or brush disposed around the shaft member in order to improve a contact property with respect to the photosensitive member, so that the toner, paper dust, an external additive deposited on the photosensitive member is liable to be deposited on the charging member.

When the surface of the charging member is contaminated, normal electroconductive property with respect to the photosensitive member is impaired to cause charging non-uniformity and improper charging, so that various structures for cleaning the surface of the charging member during image formation have been proposed.

Japanese Laid-Open Patent Application (JP-A) Hei 8-96350 discloses a charging device for cleaning the charging member by rotating a rubber roller of a rubber material excellent in toner attracting property by rotation of the charging member.

JP-A 2006-276134 discloses a charging device for cleaning the charging member by rotating a brush roller of nylon by rotation of the charging member. In this charging device, the brush roller which has an outer diameter of 10 mm (equal to that of a charging roller) and electrostatically planted fibers, each having a diameter of 17 μm and a length of 2 mm, at a density of 30,000/cm$^2$ is disposed to be abutted against the charging roller with a brush (fiber) penetration depth, i.e., an entering amount which is a depth through which fibers enter a phantom shape of a charging roller, of 0.5 mm.

In the case of the rubber roller of JP-A Hei 8-95350, a toner depositing force is large and therefore it is difficult to remove the toner from the rubber roller, so that the rubber roller is contaminated in a relatively short period to lower its cleaning performance with respect to the charging member. Further, when an addition amount of the external additive was increased with a decrease in particle size of the toner, the rubber roller and the charging roller were covered with the external additive in a relatively short period, so that it was found that the charging non-uniformity and the improper charging were caused to occur.

The brush roller of JP-A 2006-276134 is liable to accumulate the toner on the fibers thereof and for this reason, a brush roller cleaning member for sweeping out the toner from the fibers is disposed. Therefore, a rotation load of the charging roller is increased and a structure around the charging roller is complicated.

Further, as described later, the brush roller described in JP-A 2006-276134 has a small cleaning effect with respect to the external additive in the form of fine particles contained in a developer. For this reason, when the addition amount of the external additive was increased with the decrease in toner particle size, the charging roller was covered with the external additive in a short period, so that it was found that the charging non-uniformity and the improper charging occurred.

SUMMARY OF THE INVENTION

A principal object of the present invention is to provide a charging device capable of suppressing charging non-uniformity and improper charging by enhancing a cleaning performance of a cleaning member, for cleaning a charging member, rotated by rotation of the charging member in a simple constitution.

According to an aspect of the present invention, there is provided a charging device comprising:

a rotatable charging member for electrically charging a photosensitive member; and a brush, rotating along a rotational direction of said charging member by contacting the charging member to receive a force, comprising fibers for cleaning the charging member, wherein the fibers have been subjected to fiber-tilting treatment so that the fibers are tilted in a direction counterdirectionally with a rotational direction of the brush.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings. The present invention can also be carried out in other embodiments in which a part or all of constitutions in the following embodiments are replaced with alternative constitutions so long as fibers of a brush has been subjected to fiber-tilting treatment so that fibers of the brush are tilted and directed toward an upstream side of a rotational direction of a cleaning member.

Therefore, the present invention can be carried out, when a charging device electrically charges a photosensitive member by using a rotating charging member, irrespective of a constitution of an image forming apparatus in which the charging device is mounted. In the following embodiments, only a principal portion relating to formation and transfer of a toner image will be described but the present invention can be carried out in image forming apparatuses various fields of uses such as printers, various printing machines, copying machines, facsimile machines, and multi-function machines by adding necessary device, equipment, and casing structure.

Incidentally, general matters of the charging devices and the image forming apparatuses described in JP-A Hei 8-95350 and JP-A 2006-276134 will be omitted from illustration and redundant description.

1. (Image Forming Apparatus)

Figure 1:
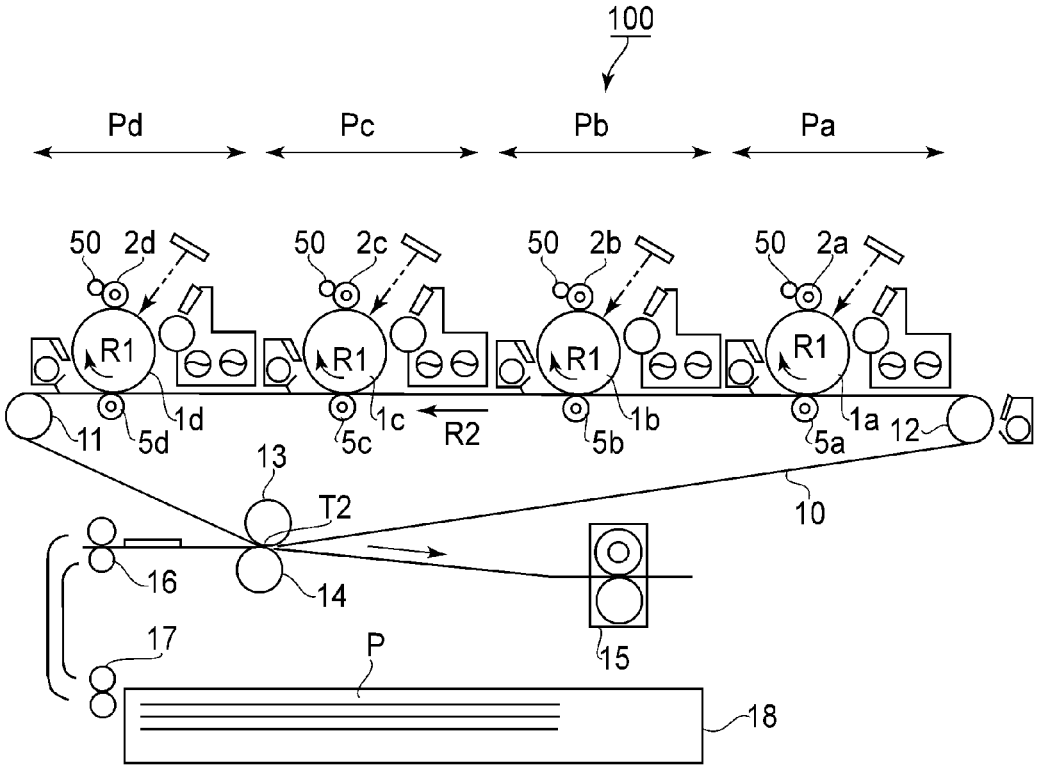
FIG. 1 is an explanatory view of a structure of an image forming apparatus.
Figure 2:
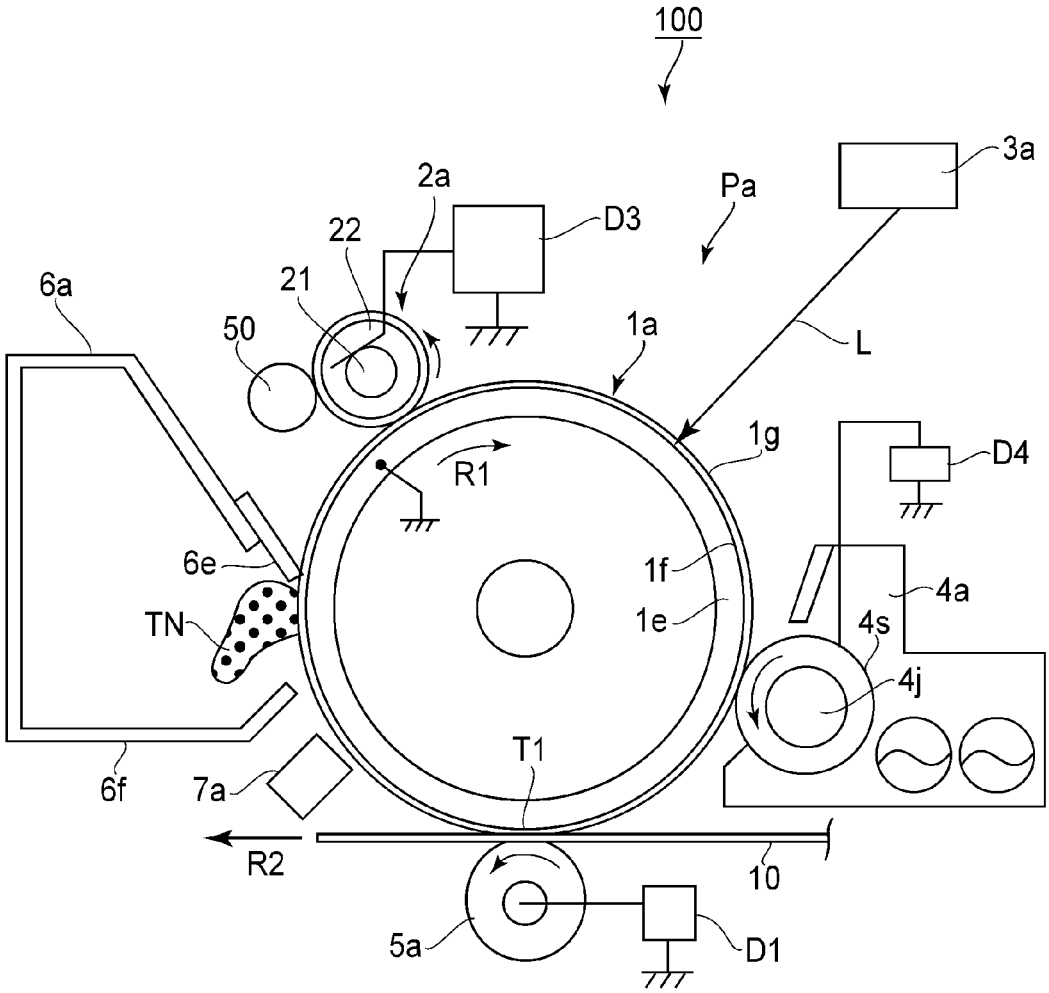
FIG. 2 is an explanatory view of a structure of an image forming portion.

FIG. 1 is an explanatory view of a general structure of the image forming apparatus and FIG. 2 is an explanatory view of a structure of an image forming portion.

As shown in FIG. 1, an image forming apparatus 100 is a full-color printer of a tandem and intermediary transfer type in which image forming portions Pa, Pb, Pc and Pd are arranged along an intermediary transfer belt 10.

At the image forming portion Pa, a yellow toner image is formed on a photosensitive drum 1*a* and then is primary-transferred onto the intermediary transfer belt 10. At the image forming portion Pb, a magenta toner image is formed on a photosensitive drum 1*b* and then is primary-transferred onto the yellow toner image on the intermediary transfer belt 10 in a superposition manner. At the image forming portions, Pc, and Pc, a cyan toner image and a black toner image are formed on photosensitive drums 1*c* and 1*d*, respectively, and then are similarly primary-transferred successively onto the intermediary transfer belt 10 in the superposition manner.

The four color toner images primary-transferred onto the intermediary transfer belt 10 are conveyed to a secondary transfer portion T2, at which the toner images are collectively secondary-transferred onto the recording material P. The recording material P on which the four color toner images are secondary-transferred are subjected to heat pressing by a fixing device 15, so that the toner images are fixed on the surface of the recording material P. Thereafter, the recording material P is discharged to the outside of the image forming apparatus 100.

The intermediary transfer belt 10 is stretched around and supported by a tension roller 12, a driving roller 11 and an opposite roller 13 and is driven by the driving roller 11 to be rotated in an arrow R2 direction at a predetermined process speed. The intermediary transfer belt 10, a tension of 30N (3 kgf) is exerted by the tension roller 12.

The recording material P drawn from a recording material cassette 18 is separated one by one by separation rollers 17 and then is sent to registration rollers 16.

The registration rollers 16 receives the recording material P in a rest state and places the recording material P in a stand-by state and feeds the recording material P toward the secondary transfer portion T2 while timing the recording material P to the toner image on the intermediary transfer belt 10.

The image forming portions Pa, Pb, Pc and Pd have the substantially same constitution except that the colors of toners of yellow for a developing device 4*a* provided in the image forming portion Pa, magenta for a developing device 4*b* provided in the image forming portion Pb, cyan for a developing device 4*c* provided in the image forming portion Pc, and black for a developing device 4*d* provided in the image forming portion Pd are different from each other. In the following description, the image forming portion Pa will be described and with respect to other image forming portions Pb, Pc and Pd, the suffix a of reference numerals (symbols) for representing constituent members (means) is to be read as b, c and d, respectively, for explanation of associated ones of the constituent members.

As shown in FIG. 2, the image forming station Pa includes the photosensitive drum 1*a*. Around the photosensitive drum 1*a*, a charging roller 2*a*, an exposure device 3*a*, the developing device 4*a*, a primary transfer roller 3*a*, an optical discharger 7*a*, and a cleaning device 6*a* are disposed in the image forming portion Pa.

Figure 3:
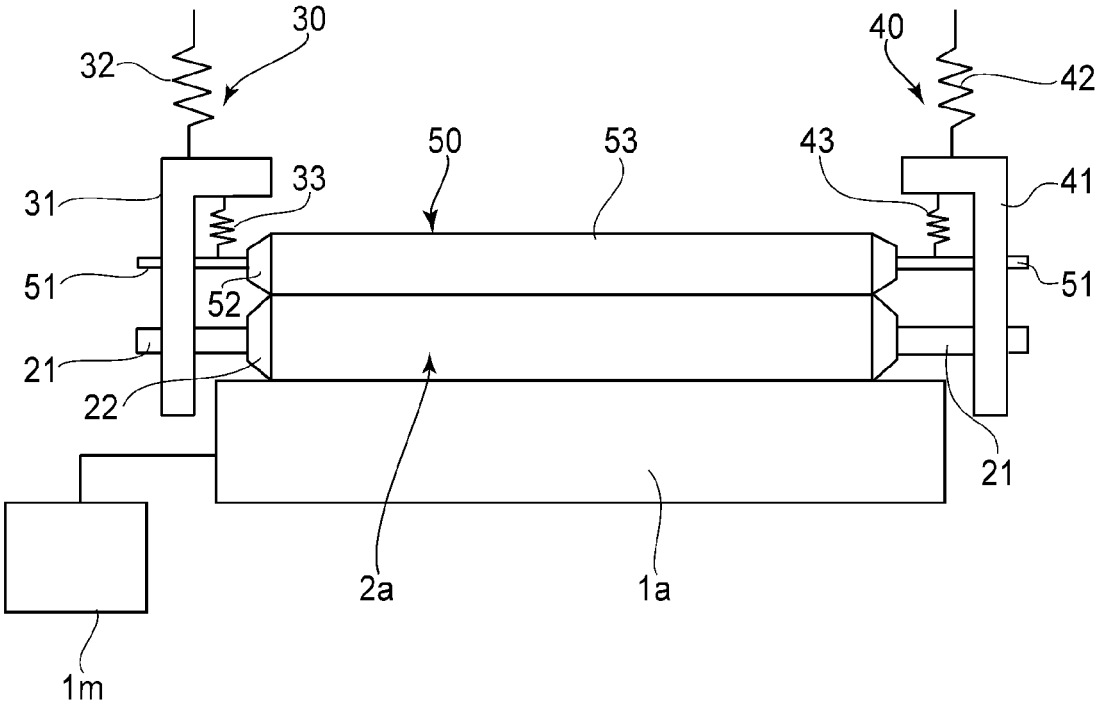
FIG. 3 is an explanatory view of a structure of an urging mechanism of a charging roller.

The photosensitive drum 1*a* is prepared by successively laminating a photoconductive layer if of an organic substrate having a negative charge polarity and a surface protective layer 1*g* containing fluorine-containing resin fine particles on an outer peripheral surface of a 1 mm-thick aluminum electroconductive support 11. The photosensitive drum 1*a* has the outer diameter of 30 mm and is rotated in the direction of the arrow R1 at the predetermined process speed by transmission thereto of a driving force from a driving motor 1*m* (FIG. 3).

The charging roller 2*a* contacts the photosensitive drum 1*a* and is rotated by the rotation of the photosensitive drum 1*a*. From a power source D3 to the charging roller 2*a*, an oscillating voltage in the form of a DC voltage based with an AC voltage is applied, so that the surface of the photosensitive drum 1*a* is electrically charged uniformly to a negative-polarity potential.

The exposure device 3*a* writes (forms) an electrostatic image for an image on the charged surface of the photosensitive drum 1*a* by scanning of the charged surface through a rotating mirror with a laser beam obtained by ON/OFF modulation of scanning line image data expanded from a separated color image for yellow.

The developing device 4*a* stirs and electrically charges a two component developer, and carries the two component developer on a developing sleeve 4*s* rotating around a fixed magnetic pole 43 in a counter direction with respect to the photosensitive drum 1*a* so as to slide on the photosensitive drum 1*a*. When an oscillating voltage in the form of a negative DC voltage biased with the AC voltage is applied from a power source D4 to the developing sleeve 4*s*, the negatively charged toner is transferred onto the electrostatic image on the photosensitive drum 1*a* which is positively charged relative to the developing sleeve 4*s*, so that the electrostatic image is reversely developed. The two component developer is prepared by mixing a non-magnetic toner and a magnetic carrier in a predetermined weight ratio and adding a small amount of an external additive. The non-magnetic toner is a pulverized resin toner having an average particle size of 5 μm to 7 μm. The external additive imparts necessary flowability to the two component developer, thus permitting smooth triboelectric charging. As the external additive, in addition to silica particles having a particle size of 1o μm or less, titanium particles or the like is used.

The primary transfer roller 5*a* urges the intermediary transfer belt 10 against the photosensitive drum 1*a*, thus forming a primary transfer portion T1 between the photosensitive drum 1*a* and the intermediary transfer belt 10.

From a power source D1, a positive DC voltage is applied to the primary transfer roller 5*a*, so that the toner image negatively charged and carried on the photosensitive drum 1*a* is primary-transferred onto the intermediary transfer belt 10 passing through the primary transfer portion T1.

The optical discharger 7*a* subjects the surface of the photosensitive drum 1*a* to linear light exposure to remove charges from the electrostatic image remaining on the photosensitive drum 1*a* from which the toner image has already been transferred. A cleaning blade 6*e* of the cleaning device 6*a* slides on the photosensitive drum 1*a* to remove transfer residual toner which passed through the primary transfer portion T1 and remains on the surface of the photosensitive drum 1*a*, thus collecting the transfer residual toner in a collecting container 6*f*.

2. (Charging Device)

FIG. 3 is an explanatory view of a structure of an urging mechanism for the charging roller 2*a* and is an enlarged view of the charging roller 2*a* and the neighborhood thereof. As shown in FIG. 2, the charging roller 2*a* as an example of the charging member is finished in an outer diameter of 14 mm by providing an elastic layer 22 on an outer surface of an electroconductive core metal 21 as a rotation shaft.

As the electroconductive core metal 21, an aluminum solid rod material having a diameter of 8 mm and a portion thereof which has not been covered with the elastic layer 22 is subjected to plating for imparting properties of rust prevention and scratch resistance within a range in which the electroconductivity is not lost. As the electroconductive core metal 21, it is also possible to use a solid or pipe metal material of iron, copper, stainless steel, or the like.

The elastic layer 22 is prepared by dispersing carbon black as an electroconductive agent in a rubber (EPDM: ethylene-propylene-diene-methylene (rubber)) as an elastic material to impart the electroconductivity, thus being adjusted to have an electric resistance of $1\times10^6$ ohm·cm. As the electroconductive agent, it is also possible to use those of an electron-conductive type such as graphite and an electroconductive metal oxide and of an ion-conductive type such as an alkali metal salt. Further, it is also possible to use other rubbers or resin materials including natural rubber; synthetic rubbers such as SBR, silicone rubber, urethane rubber, epichlorohydrin rubber, IR, BR, NBR, and CR; polyamide resin; polyurethane resin; and silicon resin. These materials can be used when they are adjusted to have the electric resistance of less than $1\times10^{10}$ ohm·cm.

The elastic layer 22 has been subjected to abrading processing so as to have a so-called crown shape such that its longitudinal central portion is thick and its longitudinal end portions are thin in consideration of flexure during urging thereof against the photosensitive drum (member) 1*a*. This is because the charging roller 2*a* has such a structure that the both end portions of the charging roller 2*a* receive a predetermined urging force toward the photosensitive drum 1*a* by urging mechanisms 30 and 40 shown in FIG. 3. That is, there is a tendency that a contact pressure of the charging roller 2*a* against the photosensitive drum 1*a* is small at the central portion compared with the case of the both end portions and therefore the tendency is required to be eliminated to realize uniform contact pressure.

To the electroconductive core metal 21, a power source D3 for applying the charging bias to the charging roller 2*a* is connected. The power source D3 applies to the charging roller 2*a*, as the charging bias, the oscillating voltage in the form of the DC voltage biased with the AC voltage. The charging bias is adjusted based on various factors but may be, as an example, the oscillating voltage in the form of the DC voltage of −600 V biased with the AC voltage having a peak-to-peak voltage of 1700 V. As shown in FIG. 3, the charging roller 2*a* contacts the photosensitive drum 1*a* while being shaft-supported by the urging mechanism 30 and 40 at both ends. The urging mechanisms 30 and 40, a brush roller 50, and the like are provided to each of the image forming portions Pa, Pb, Pc and Pd shown in FIG. 1.

The electroconductive core metal 21 of the charging roller 2*a* is rotatably supported at its end portions by shaft-supporting members 31 and 41. The shaft-supporting members 31 and 41 are urged toward the photosensitive drum 1*a* by urging springs 32 and 42, so that a predetermined contact pressure of the rotatably provided charging roller 2*a* against the photosensitive drum 1*a* is set. By the contact of the charging roller 2*a* with the photosensitive drum 1*a* at the predetermined contact pressure, a frictional force is generated between the charging roller 2*a* and the photosensitive drum 1*a*, so that the charging roller 2*a* is rotated in the predetermined direction by the rotation of the photosensitive drum 1*a*.

As shown in FIG. 2, during image formation, most of untransferred toner TN, paper dust, the external additive, and the like which are deposited on the photosensitive drum 1*a* as the example of the photosensitive member are collected and removed by the cleaning blade 6*e* of the cleaning device 6*a*. However, some amounts of the toner particles and the external additive particles pass through the cleaning blade 6*e* are taken along by the photosensitive drum 1*a* to reach the charging roller 2*a*, thus being deposited on the surface of the charging roller 2*a*. The thus-caused contamination of the charging roller 2*a* prevents charge transfer between the charging roller 2*a* and the photosensitive drum 1*a*, thus causing the charging non-uniformity and the improper charging on the photosensitive drum 1*a* to result in image defect. That is, the charging roller 2*a* rotating in the predetermined direction contacts the electrically charges the photosensitive drum 1*a*, so that the toner and the external additive deposit on the charging roller 2*a* rotating in the predetermined direction although the amount of thereof is slight. Then, with repetition of image formation, when the toner and the external additive are accumulated on the surface of the charging roller 2*a*, there is a possibility of the accumulation to the extent that the charging step cannot be properly performed. When such an accumulation state is left as it is, an increase in life time of the charging roller 2*a* cannot be achieved.

Figure 5:
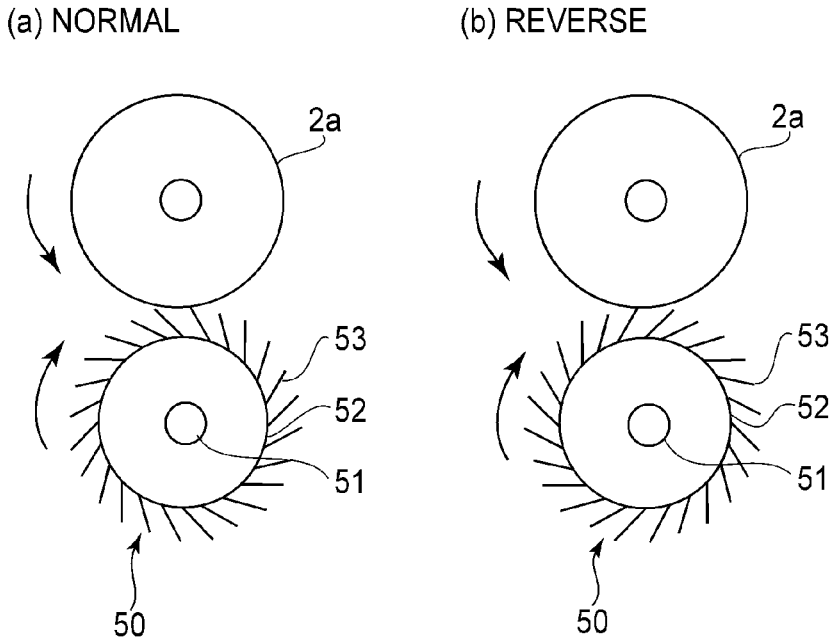
FIG. 5(*a*) is a schematic view for illustrating an oriented state (normal rotation) of fibers of a brush roller and FIG. 5(*b*) is a schematic view for illustrating an oriented state (reverse rotation) of the fibers of the brush roller.

In the image forming apparatus 100, in order to remove the contamination of the charging roller 2*a*, the brush roller 50 as the example of the cleaning member is provided. The brush roller 50 is provided so as to be rotated by the rotation of the charging roller 2*a* and is provided with a brush for cleaning the charging roller 2*a*. The brush roller 50 has been subjected to fiber-tilting treatment so that fibers of the brush are tilted and directed toward the upstream side of the rotational direction of the brush roller 50, i.e., in the direction counterdirectionally with the rotational direction of the brush roller 50. Specifically, the fibers of the brush have been subjected to the fiber-tilting treatment as shown in FIG. 5(*a*). For this reason, the brush roller 50 is abutted and urged against the charging roller 2*a* so that the fibers of the brush are protruded in their longitudinal direction, so that the brush roller 50 is rotated by a driving force from the surface of the charging roller 2*a*. In other words, the brush roller 50 contacts the charging roller 2*a* to receive a force, so that the brush roller 50 is rotated to follow the charging roller rotational direction.

When the brush roller 50 is rotated by the rotation of the charging roller 2*a*, the fibers of the brush are in a so-called backward-pointing state, so that tips of a large number of the fibers of the brush abut against the rotating charging roller surface in a collision member, thus scraping the deposited matter (the external additive or the like) from the surface of the charging member to jump the deposited matter up. For this reason, compared with the case where the brush roller 50 is rotated in the opposite direction by the rotation of the charging roller 2*a* and the case where the fibers are not oriented, i.e., in a straight fiber state, an effect of removing the deposited matter (external additive) from the charging member surface is high, so that the external additive is less liable to be taken in gaps among the fibers of the brush. Therefore, in a simple constitution, a cleaning performance, with respect to the charging roller 2*a*, of the brush roller 50 rotated by the rotation of the charging roller 2*a* can be enhanced, so that occurrences of the charging non-uniformity and the improper charging can be suppressed.

Here, the rotation of the brush roller 50 by the rotation of the charging roller 2*a* means that the brush roller 50 is rotated in a with (following) direction at a peripheral speed lower than that of the charging roller 2*a* by contacting the charging roller 2*a* and receiving the driving force from the charging roller 2*a*. That is, the rotation of the brush roller 50 rotated by receiving the driving force in contact with the charging roller 2*a* is referred to as the rotation of the brush roller 50 by the rotation of the charging roller 2*a*. In the present invention, the fibers of the brush roller contact the charging roller 2*a*, so that the brush roller 50 is not rotated at the speed higher than that of the charging roller 2*a* even when the brush roller 50 is rotated by the rotation of the charging roller 2*a*. The fiber tilting means that the fibers of the brush are obliquely tilted with respect to the rotational direction of the brush roller 50 (with an angle from a normal to the brush roller 50), and the fiber-tilting treatment refers to treatment for tilting the fibers of the brush in such a manner with respect to a base portion 52 (FIGS. 5(*a*) and 5(*b*)) of the brush roller 50. The brush roller 50 is set to have a diameter/length ratio of the fibers and a tip penetration amount with respect to the charging roller 2*a* so that a contact pressure is created by flexure elastic deformation of the fibers obliquely contacting the surface of the charging roller 2*a* due to the orientation of the fibers. Further, a normal-reverse rotational speed ratio for evaluating the cleaning performance of the brush roller 50 with respect to the charging roller 2*a* is studied. That is, it was confirmed that the cleaning performance for the external additive is considerably exhibited when a ratio of the rotational speed ratio of the brush roller 50 to the charging roller 2*a* in the case where the brush roller 50 is rotated in a reverse (opposite) direction by the rotation of the charging roller 2*a* to the rotational speed ratio of the brush roller 50 to the charging roller 2*a* in the case where the brush roller 50 is rotated in a normal direction by the rotation of the charging roller 2*a* is 80% or less. Further, in order to suppress a rotational resistance of the charging roller 2*a* rotated by the rotation of the photosensitive drum 1*a*, a rotational load of the brush roller 50 is alleviated without disposing the brush roller cleaning member as described in JP-A 2006-276134. The brush roller 50 is set to have a small rotational resistance so as to be rotated by the rotation of the charging roller 2*a* within a range in which the fibers do not cause buckling. Further, in order to enhance a centrifugal force for remove the external additive deposited on the fibers of the brush roller 50, the diameter of the brush roller 50 is set at 6 mm considerably smaller than the charging roller diameter of 14 mm. Incidentally, the charging member for electrically charging the photosensitive member may be formed in a belt shape.

According to an experiment of the present inventor, the fibers of the brush roller 50 may preferably be nylon fibers having a circular cross-sectional shape, a diameter of 20 μm or more and 30 μm or less, a free length of 0.5 mm or more and 0.8 mm or less, and a fiber-planting density of 50,000 fibers/inch$^2$ or more and 600,000 fibers/inch$^2$. The fiber-planting density may more preferably be 100,000 fibers/inch$^2$ or more and 300,000 fibers/inch$^2$. Further, in order to enhance a flexible reaction force of the fibers of the brush roller 50, the fibers which have been electrostatically planted vertically on the surface of the metal rod may be thermally deformed and oriented or the fibers may also be electrostatically planted obliquely from the beginning.

3. (Charging Roller Cleaning Device)

Figure 4:
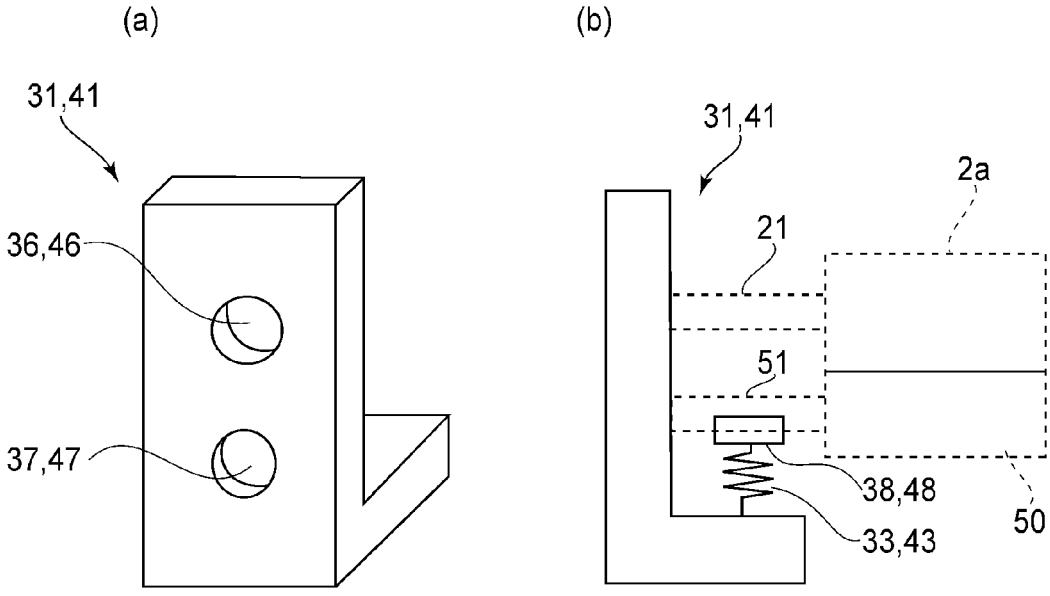
FIG. 4(*a*) is a perspective view of a structure of a shaft-supporting member and FIG. 4(*b*) is a front view of the shaft-supporting member.

FIGS. 4(*a*) and 4(*b*) are schematic views for illustrating the structure of the shaft-supporting member and FIGS. 5(*a*) and 5(*b*) are schematic views for illustrating the orientation state of the fibers of the brush roller. FIGS. 4(*a*) and 4(*b*) illustrate the shaft-supporting members 31 and 41 for shaft-supporting the charging roller 2*a* and the brush roller 50 in an enlarged manner. The shaft-supporting member 41 has the same constitution and function as those of the shaft-supporting member 31.

As shown in FIG. 3, the charging roller 2*a* and the brush roller 50 are rotatably held at longitudinal end portions by the shaft-supporting members 31 and 41. The shaft-supporting members 31 and 41 have such a structure that they are urged toward the photosensitive drum 1*a* by urging springs 32 and 42, respectively, while holding the charging roller 2*a* and the brush roller 50. In such a constitution, the brush roller 50 is rotated by the rotation of the charging roller 2*a* rotated by the rotation of the photosensitive drum 1*a*, thus cleaning the surface of the charging roller 2*a*.

As shown in FIG. 4(*a*) (perspective view), the shaft-supporting members 31 and 41 manufactured of a low friction coefficient material ("DURACON" (registered trademark)) by machining are provided with shaft-support holes 36 and 46 and shaft-supporting holes 37 and 47. As shown in FIG. 4(*b*) (front view), into the shaft-supporting holes 37 and 47, a rotation shaft 51 of the brush roller 50 is rotatably inserted. The rotation shaft 51 is made thinner than the core metal 52, thus being decreased in rotation-frictional resistance. At the end portions of the rotation shaft 51 of the brush roller 50, the brush roller 50 is urged toward the charging roller 2*a* by urging springs 33 and 43 assembled into the shaft-support members 31 and 41. The urging springs 33 and 43 are disposed between barrels 38 and 48 rotatably holding the rotation shaft 51 and the shaft-supporting members 31 and 41 in a compressed state. As a result, the rotation shaft 51 of the brush roller 50 is supported by the shaft-supporting holes 37 and 47 while being urged by the urging springs 33 and 43. The shaft-supporting holes 37 and 47 are, different from the shaft-supporting holes 36 and 46 for the charging roller 2*a*, formed in a size such that the rotation shaft 51 is movable in the urging direction of the urging springs 33 and 43 by a certain distance. This is because a shaft center of the brush roller 50 can be moved by the urging.

As shown in FIG. 5(*a*), the brush roller 50 is a rotatable brush, having an outer diameter of 6 mm, on which a large number of short brush fibers 53 are densely planted on the core metal 52. In FIGS. 5(*a*) and 5(*b*), the fibers 53 are exaggeratedly illustrated in the cross-sectional view of the charging roller 2*a* and the brush roller 50, picked out from FIG. 3, as seen from an end portion side, and the rotational directions of the charging roller 2*a* and the brush roller 50 are added.

The fibers 53 of the brush roller 50 may preferably have a fiber thickness of 1-10 d (denier), particularly 3-6 d. The diameter of the nylon fibers having the fiber thickness of 3 d is about 20 μm and the diameter of the nylon fibers having the fiber thickness of 6 d is about 30 μm. Therefore, in terms of the fiber diameter, the fibers may preferably have the diameter of 20 μm or more and 30 μm or less. As described above, the fibers 53 of the brush roller 50 may preferably have the fiber-planting density of 50,000 fibers/inch$^2$ or more and 600,000 fibers/inch$^2$ or less, particularly 100,000 fibers/inch$^2$ or more and 300,000 fibers/inch$^2$ or less. As the material for the fibers of the brush roller 50, it is preferable that PET, acrylic resin, rayon, nylon, synthetic fiber and the like are used. As the state of the fibers 53 immediately after the planting, the straight fiber state and the tilted fiber state can be considered.

Embodiment 1

In these circumstances, in Embodiment 1, the following cleaning condition is set. The fibers 53 have the fiber thickness of 3 d (denier) and the fiber (free) length of 0.5 mm and are formed of nylon fibers as the fiber material. The nylon fibers are electrostatically planted on the core metal 52 and then subjected to the fiber-tilting treatment, so that the fibers 53 are tilted by an average tilting angle of 45 degrees from the straight fiber state. As the fiber-tilting treatment, heat treatment such that a heated forming iron is pressed against the side surface of the brush roller 50 while rotating the brush roller 50 on which the fibers have been electrostatically planted on the core metal in the straight fiber state.

By the urging of the urging springs 33 and 43 shown in FIG. 5(*b*), as shown in FIG. 5(*a*), the brush roller 50 is urged against the surface of the charging roller 2*a*, so that a part of the circular counter peripheral surface of the fibers 53 penetrates into the charging roller 2*a*. In this embodiment, the urging force of the urging springs 33 and 43 is set so that the penetration amount (depth) of the fibers 53 is 0.2 mm with respect to the fiber length of 0.5 mm (tilted fiber height of 0.36 mm).

As shown in FIG. 5(*a*), the fibers 53 of the brush roller 50 are used in a state in which a line connecting the fiber tip of the fibers 53 to the surface of the core metal 52 as an example of the base portion is not perpendicular to the core metal surface but is tilted in a certain direction. The thus-formed brush roller 50 is disposed so that the fibers 53 are tilted in the direction counterdirectionally with the rotational direction of the brush roller 50, thus cleaning the surface of the charging roller 2*a* during the rotation thereof by the rotation of the charging roller 2*a*. That is, during the rotation of the brush roller 50 by the rotation of the charging roller 2*a*, the large number of the tips of the fibers 53 of the brush roller 50 successively abut against the surface of the charging roller 2*a* to scrape and remove the fine particles of the external additive from the charging roller surface.

In the case where the fibers 53 of the brush roller 50 are tilted as shown in FIG. 5(*a*), compared with the case where the fibers 53 of the brush roller 50 are tilted as shown in FIG. 5(*b*) in the direction opposite to that of the fibers 53 shown in FIG. 5(*a*), the cleaning performance of the brush roller 50 with respect to the external additive is considerably enhanced. That is, in the case where the fibers 53 are oriented in the direction opposite from the rotational direction of the brush roller 50 is superior in cleaning performance to the fibers 53 oriented in the direction identical to the rotational direction of the brush roller 50 and the fibers 53 in the straight fiber state. With respect to this phenomenon, a verification result is shown in Table 1.

TABLE 1

| | Brush state | | | |
|---|---|---|---|---|
| | Straight | | Tilted | |
| | Rotation | | | |
| Figure | Normal — | Reverse — | Normal 5(a) | Reverse 5(b) |
| *1 Speed ratio | 55% | 51% | 63% | 50% |
| *2 Cleaning level | B | B | A | B |
| *3 Image defect | B | B | A | B |

*1: "Speed ratio" represents a ratio of the rotational (peripheral) speed of the brush roller 50 to the rotational (peripheral) speed of the charging roller 2a when the brush roller 50 is rotated by the rotation of the charging roller 2a and the rotational (peripheral) speed of the charging roller 2a is taken as 100%.
*2: "Cleaning level" was evaluated by observing a surface state of the charging roller 2a removed at the time when a solid black image was continuously formed on 10,000 sheets of A4-sized plain paper (long edge feeding). With respect to the cleaning level, "A" represents a state in which there is no contamination on the charging roller 2a and "B" represents a state in which the contamination remains on the charging roller 2a.
*3: "Image defect" was evaluated as to whether or not the image defect due to improper charging with respect to the solid black image subjected to the evaluation of "Cleaning level" occurs. With respect to "Image defect", "A" represents no occurrence of the image defect and "B" represents the occurrence of the image defect. Here, the image defect due to the improper charging is a phenomenon such that partial resistance increase is generated by the contamination of the charging roller 2a with the deposited matter and therefore the surface of the photosensitive drum la cannot be electrically charged to a desired potential to result in an occurrence of density difference on an output product.

Table 1 shows the result of comparison of the cleaning performance of the brush roller 50 rotated in two (normal and reverse) directions by the rotation of the charging roller 2*a* with respect to the case where the fibers 53 of the brush roller 50 are the straight fibers and the case where the fibers 53 of the brush roller 50 are the tilted fibers. Specifically, the brush roller 50 was rotated by the rotation of the charging roller 2*a* in the two (normal and reverse) directions and was subjected to measurement of the rotational speed both in the cases of the straight fibers and the tilted fibers to evaluate the cleaning level of the charging roller 2*a* and whether or not the image defect occurs.

With respect to the two (normal and reverse) rotational directions, in the case where the fibers 53 of the brush roller 50 are the tilted fibers, the rotational direction of the brush roller 50 shown in FIG. 5(*a*) is referred to as the normal rotation and the rotational direction of the brush roller 50 shown in FIG. 5(*b*) in which the mounting direction of the rotational shaft of the brush roller 50 (FIG. 5(*a*)) is 180-degree turned with respect to the longitudinal direction of the brush roller 50 so as to orient the fibers 53 of the brush roller 50 as shown in FIG. 5(*b*).

As shown in FIG. 5(*a*), in the case where the fibers 53 of the brush roller 50 are the tilted fibers, when the brush roller 50 is rotated in the normal direction by the rotation of the charging roller 2*a*, the tilted fiber direction (counter direction) of the brush roller 50 is opposite from (counterdirectionally with) the rotational direction of the charging roller 2*a*. As shown in FIG. 5(*b*), in the case where the fibers 53 of the brush roller 50 are the tilted fibers, when the brush roller 50 is rotated in the reverse direction by the rotation of the charging roller 2*a*, the tilted fiber direction (with direction) of the brush roller 50 is identical to (codirectionally with) the rotational direction of the charging roller 2*a*. On the other hand, in the case where the fibers of the brush roller 50 are the straight fibers, first rotation of the brush roller 50 by the rotation of the charging roller 2*a* is referred to as the normal rotation and second rotation of the brush roller 50 mounted in such a manner that the rotation shaft of the brush roller 50 is 180-degree turned with respect to the longitudinal direction of the brush roller 50 and is then mounted is referred to as the reverse rotation. In the case where the fibers 53 of the brush roller 50 are the straight fibers, the directions of the normal and reverse rotations of the brush roller 50 by the rotation of the charging roller 2*a* are not different from those shown in FIG. 5(*a*) (this embodiment) and FIG. 5(*b*) (Comparative Embodiment) aside from the tilting state of the tips of the fibers, thus being omitted from illustration.

The peripheral speed (rotational speed) of the charging roller 2*a* is read by a laser Doppler speed meter at the outer peripheral surface of the charging roller 2*a*, and the peripheral speed (rotational speed) of the brush roller 50 is also read by the laser Doppler speed meter at the outer peripheral surface of the core metal 52 on which the fibers 53 have not been planted. The thus-read values of the peripheral speeds are converted into those of the peripheral speeds of the charging roller 2*a* and the brush roller 50 at their contact position. The charging roller 2*a* is rotated always at the constant (predetermined) speed, so that the values of the rotational speed ratio in Table 1 can be regarded as numerical values which relatively represent the peripheral speeds of the brush roller 50.

As shown in FIG. 1, with respect to the rotational speed ratio of the brush roller 50 to the charging roller 2*a*, in the case where the fibers 53 of the brush roller 50 are the straight fibers, there is no large difference in rotational speed ratio with respect to the rotational directions of the brush roller 50.

However, in the case where the fibers 53 of the brush roller 50 are the tilted fibers, there is a large difference in rotational speed ratio with respect to the rotational directions of the brush roller 50. In the case of the normal rotation shown in FIG. 5(*a*), the brush roller 50 is rotated at the peripheral speed of 63% of that of the charging roller 2*a* and on the other hand, in the case of the reverse rotation shown in FIG. 5(*b*), the peripheral speed of the brush roller 50 is 50% which is lower than that (63%) in the case of the normal rotation by about 20%. This means, as shown in FIG. 5(*a*), that traction (grip) of the tilted fibers 53 and the surface of the charging roller 2*a* is increased in the normal rotation and therefore the brush roller 50 is liable to be rotated by following the rotation of the charging roller 2*a*. Further, as shown in FIG. 5(*b*), in the reverse rotation, the traction (grip) of the tilted fibers 53 and the surface of the charging roller 2*a* is decreased and therefore the brush roller 50 is liable to slip on the charging roller surface and is decreased in rotational speed.

More specifically, in the case of the normal rotation in which the fibers 53 are tilted in the direction counterdirectionally with the rotational direction of the brush roller 50, the fibers 53 are tilted in the direction in which the resistance to the rotation is increased. For this reason, the traction between the brush roller 50 and the charging roller surface is increased and thus the frictional force can be effectively transmitted to the brush roller 50, so that the followability of the rotation of the brush roller 50 with respect to the rotation of the charging roller 2*a* is improved. On the other hand, in the case where the fibers 53 are tilted codirectionally with the rotational direction of the brush roller 50, the charging roller 2*a* rotates so as to stroke the tilted fibers 53 and thus the resultant traction is small, so that the rotational speed is decreased.

With respect to the cleaning level and the occurrence of the image defect, in the case where the rotational speed ratio of the brush roller 50 to the charging roller 2*a* is highest, i.e., only in the case where the brush roller 50 having the tilted fibers 53 are normally rotated by the rotation of the charging roller 2*a*, there is no occurrence of the image defect. In other cases, also due to a severe condition such as the solid black image, the contamination of the charging roller 2*a* with the deposited matter caused to improper charging, so that the image defect occurred.

The cleaning performance of the brush roller 50 with respect to the rubber roller is considered to be increased at the contact position between the brush roller 50 and the rubber roller in the case where the rotational speeds of the brush roller 50 and the rubber roller are equal to each other. This is because in the case where the brush roller 50 and the rubber roller contact at different speeds, the contaminant on the rubber roller is rubbed into the rubber roller by the brush roller 50 to be placed in a difficult cleaning state.

Therefore, in order to enhance the cleaning performance of the brush roller 50, there is need to increase the rotational speed ratio of the brush roller 50 to the charging roller 2*a*. For this purpose, setting of the direction of the rotation of the brush roller 50 by the rotation of the charging roller 2*a* so as to increase the rotational speed ratio by utilizing the brush roller 50 having the tilted fibers is effective.

In Embodiment 1, in the constitution shown in FIGS. 2, 3, 4(*a*) and 4(*b*), a relationship between the peripheral speed of the brush roller 50 and the peripheral speed of the charging roller 2*a* is brought near to an ideal state by utilizing the brush roller 50 having the tilted fibers. As a result, it was possible to realize the constitution in which the cleaning performance for the charging roller is high.

The effect of increasing the rotational speed ratio of the rotation of the brush roller 50 by the rotation of the charging roller 2*a* depending on the tilted fiber state can be evaluated by the rotational speed ratios of the same brush roller during the rotations in the normal direction and the reverse (opposite) direction. For example, the rotational speed increasing effect can be evaluated by a ratio of the rotation speed ratio in the case of the normal rotation shown in FIG. 5(*a*) to the rotational speed ratio in the case of the reverse rotation shown in FIG. 5(*b*).

The rotational speed of the brush roller 50 rotated by the rotation of the cleaning performance 2*a* is largely changed depending on the material for the fibers of the brush roller 50, the material for the charging roller 2*a*, the urging force, and the like. However, by using the parameter of the ratio of the rotational speed ratio during the normal rotation to the rotational speed ratio during the reverse rotation, only the effect of the tilted fibers can be selectively evaluated. The effect of increasing the rotational speed of the brush roller 50, rotated by the rotation of the charging roller 2*a*, depending on the tilted fiber state can be evaluated only by paying attention to a degree of a change in rotation speed ratio of the brush roller 50 to the charging roller 2*a* when the rotational direction of the brush roller 50 is reversed. In the case where there is a large difference in rotational speed of the brush roller 50 between the rotational directions shown in FIGS. 5(*a*) and 5(*b*), as described above, the brush roller 50 may only be required to be rotated by the rotation of the charging roller 2*a* in a direction, in which the rotational speed thereof is higher, of the rotational directions shown in FIGS. 5(*a*) and 5(*b*). In this way, by rotating the brush roller 50 by the rotation of the charging roller 2*a* to clean the charging roller 2*a*, the cleaning performance can be improved.

In the case of the brush roller having the straight fibers shown in Table 1, the rotational speed ratio of the brush roller 50 to the charging roller 2*a* is 55% during the normal rotation and is 51% during the reverse rotation. In this case, when the degree of change is defined as a "ratio of the rotational speed ratio with respect to a lower rotational speed direction to the rotational speed ratio with respect to a higher rotational speed direction", the degree of change is $51/55 \approx 0.927$, i.e., 90% or more, so that the difference in rotational speed ratio is small. In this case, the image defect occurs and thus a desired cleaning performance cannot be obtained. On the other hand, in the case of the brush roller having the tilted fibers, the degree of change is $50/63 \approx 0.793$, i.e., 80% or less. In this case, the image defect was not caused to occur and thus the surface of the charging roller 2*a* was cleaned successfully.

That is, when the parameter of "ratio of the rotational speed ratio with respect to a lower rotational speed direction to the rotational speed ratio with respect to a higher rotational speed direction" is small, the cleaning performance is enhanced. Further, this parameter depends on a degree of the tilting of the fibers, flexibility (strength) of the fibers 53, and the like and it was clarified that the cleaning performance is improved when the value of the parameter is 80% or less.

In addition to this parameter, in order to enhance the cleaning performance with respect to the external additive, it is important that rigidity of the fibers 53 is ensured by managing the diameter/length ratio of the fibers 53 depending on the material for the fibers 53. When the diameter is increased, the rigidity of the fibers 53 in the so-called backward-pointing state is increased, so that the brush roller 50 can receive a large driving force from the charging roller 2*a*. However, it is considered that occasion of impact with respect to the external additive having a small particle size and therefore the cleaning performance is lowered. For this reason, the increase in rigidity of the fibers 53 by decreasing the length of the fibers 53 without increasing the cross-sectional area is a desirable choice for rotating the brush roller 50 at high speeds by receiving the large driving force from the charging roller 2*a*. Therefore, the similar study as in Embodiment 1 was made by changing the length (fiber length) of the fibers 53 of the brush roller 50 while fixing the thickness of the fibers 53 of the brush roller 50. As a result, it was confirmed that the high cleaning performance similar to that in the case of the fiber 53 length of 0.5 mm in the constitution of Table 1 was obtained in the cases where the (fiber) length of the fibers 53 was 0.6 mm, 0.7 mm, and 0.8 mm.

However, in the cases where the fiber 53 length was 0.9 mm and 1.0 mm, it was found that the traction between the brush roller 50 and the charging roller 2*a* was decreased to be less liable to rotate the brush roller 50 and thus the cleaning performance was lowered. Therefore, the length of the fibers 53 may preferably be 0.5 mm or more and 0.8 mm or less as the free length capable of flexure deformation. In the constitution of JP-A 2006-276134, as described above, the (fiber) length of the fibers 53 is 2 mm, so that the cleaning performance with respect to the external additive is considered to be lowered since the traction between the brush roller 50 and the charging roller 2*a* is decreased and thus the brush roller 50 is less liable to be rotated. Further, the fibers formed of the nylon fibers which are the same material as in Embodiment 1 has the diameter of 17 μm and thus the diameter/length ratio is considerably smaller than that in Embodiment 1 to result in insufficient rigidity of the fibers, so that the performance of removing the external additive from the charging roller is considered to be lowered correspondingly to the insufficient rigidity.

The brush roller 50 in Embodiment 1 is disposed with the length of the fibers of 0.5 mm and the fiber penetration amount (depth) of 0.2 mm with respect to the charging roller. For this reason, compared with the brush roller of JP-A Hei 8-95350 in which the brush roller is disposed with the fiber length of 2 mm and the penetration amount of 0.5 mm with respect to the charging roller, the brush roller 50 in Embodiment 1 has the fibers 53 which function with a large elastic force and a large repelling force. For this reason, rather than the rubbing of the charging roller surface with the side surface of the brush roller, a tendency to stick and abrade the charging roller surface by the tips of fibers is increased, so that the cleaning performance with respect to the external additive is considered to be enhanced.

Further, the brush roller of JP-A Hei 8-95350 has the substantially same diameter as that of the charging roller, so that the brush roller has an angular speed of rotation smaller than that of the brush roller 50 in Embodiment 1. For this reason, it is considered that the performance of removing the external additive from the brush roller is insufficient. On the other hand, as described above, the brush roller 50 in Embodiment 1 has the diameter of 6 mm set considerably smaller than that (14 mm) of the charging roller 2*a* in order to enhance the centrifugal force for removing the external additive deposited on the fibers 53. For this reason, the brush roller 50 in Embodiment 1 does not require the brush roller cleaning member used for the brush roller as in JP-A 2006-276134, so that the brush roller cleaning member constitutes the rotation resistance and thus does not prevent the rotation of the brush roller.

Embodiment 2

Figure 6:
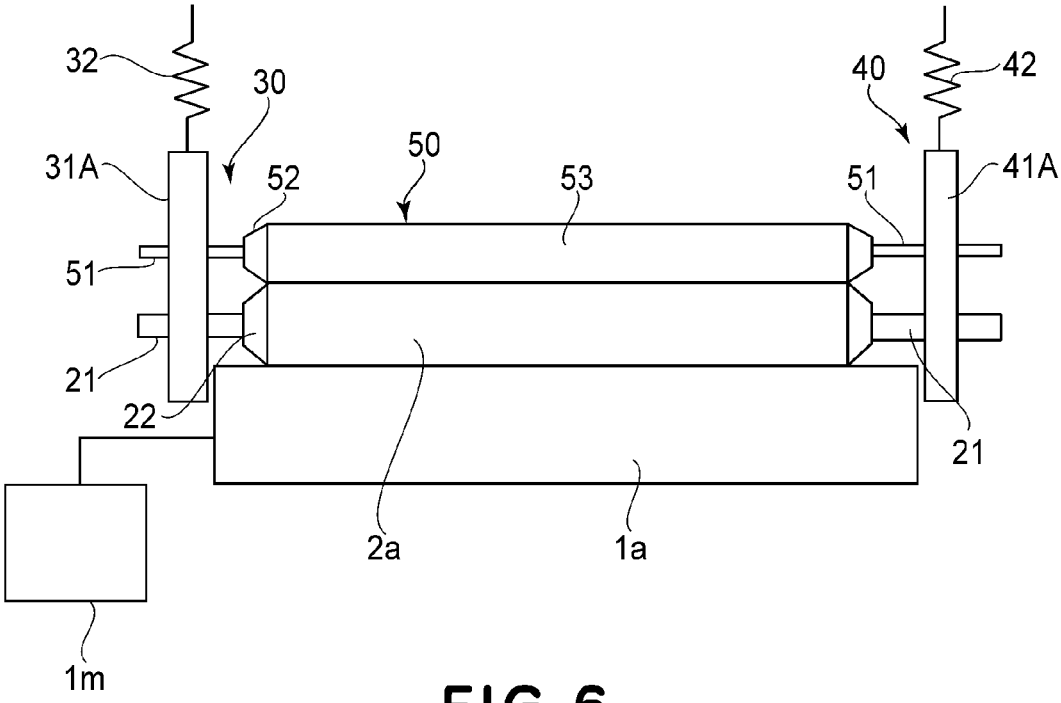
FIG. 6 is an explanatory view of a structure of an urging mechanism of a charging roller in Embodiment 2.
Figure 7:
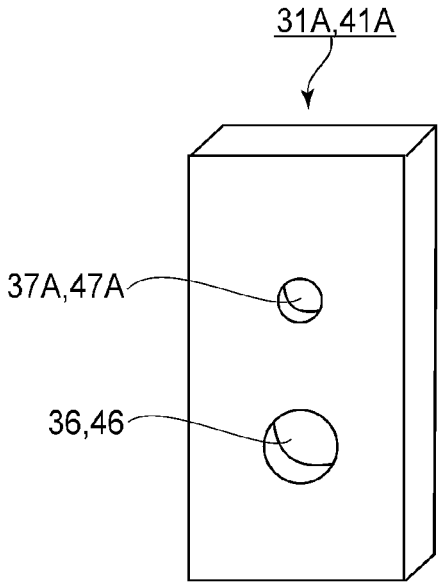
FIG. 7 is an explanatory view of a structure of a shaft-supporting member in Embodiment 2.

FIG. 6 is an explanatory view of a structure of a charging roller urging mechanism in Embodiment 1 and FIG. 7 is an explanatory view of a structure of a shaft-supporting member in Embodiment 2. Specifically, FIG. 6 is an enlarged view of the charging roller 2*a* and the neighborhood thereof and FIG. 7 is an enlarged view of shaft-supporting members 31A and 41A for shaft-supporting the charging roller 2*a* and the brush roller 50.

In Embodiment 1, as shown in FIG. 4(*b*), the brush roller 50 is supported movably upward and downward and the fiber penetration amount of the brush roller 50 with respect to the surface of the charging roller 2*a* is set by the urging with the urging springs 33 and 43. On the other hand, in Embodiment 2, the distance between the rotation shafts of the charging roller 2*a* and the brush roller 50 is fixed and the fiber penetration amount of the brush roller 50 with respect to the surface of the charging roller 2*a* is set by flexure and deflection of the fibers 53. Embodiment 2 has the same constitution that of Embodiment 1 except for the size of shaft-supporting holes provided in the shaft-supporting members and the presence and absence of the urging springs 33 and 43, so that overlapping portions between FIGS. 6 and 7 and FIGS. 3, 4(*a*) and 4(*b*) are represented by the same reference numerals or symbols and will be omitted from redundant description.

As shown in FIG. 6, the charging roller 2*a* and the brush roller 50 are rotatably held by shaft-supporting members 31A and 41A at longitudinal end portions thereof so as to keep a distance between the rotation shafts thereof at a constant level. As shown in FIG. 7 with reference to FIG. 6, the shaft-supporting members 31A and 41A are provided with shaft-supporting holes 36 and 46 for supporting the charging roller 2*a* and shaft-supporting holes 37 and 47 into which the rotation shaft 51 of the brush roller 50 is to be inserted. The distance between the rotation shafts of the charging roller 2*a* and the brush roller 50, i.e., a center distance is kept contact by keeping the distance between the shaft-supporting holes 36 and 46 and the shaft-supporting holes 37 and 47 at a constant level.

The charging roller 2*a* and the brush roller 50 providing the center distance (between the rotation shafts thereof) are disposed at positions in which the brush roller 50 can be rotated by the rotation of the charging roller 2*a* while ensuring mutual traction between the charging roller 2*a* and the brush roller 50. In this embodiment, the center distance is set so that the brush roller 50 prepared similarly as in Embodiment 1 contacts the charging roller 2*a* with the fiber penetration amount of 0.2 mm. In Embodiment 2, the center distance (between the charging roller 2*a* and the brush roller 50) can always be maintained, so that it is possible to keep a state in which the fibers of the brush roller 50 penetrate the charging roller 2*a* in a predetermined amount.

In Embodiment 2 employing the above-described constitution, the cleaning performance was evaluated during the normal rotation and the reverse rotation with respect to the cases where the brush roller 50 had the straight brush and had the tilted brush. Specifically, similarly as in Embodiment 1, the experiment with respect to the rotational speed ratio, the cleaning level for the charging roller 2*a* and the occurrence of the image defect in the above conditions was conducted. The result is shown in Table 2.

TABLE 2

| | Brush state | | | |
|---|---|---|---|---|
| | Straight | | Tilted | |
| | Rotation | | | |
| | Normal | Reverse | Normal | Reverse |
| Figure | — | — | 5(a) | 5(b) |
| *1 Speed ratio | 53% | 49% | 64% | 45% |
| *2 Cleaning level | B | B | A | B |
| *3 Image defect | B | B | A | B |

The evaluation standards of *1, *2 and *3 are identical to those in Table 1, thus being omitted from redundant explanation.

As shown in Table 2, similarly as in the case of Embodiment 1, only in the case where the brush roller 50 had the tilted fibers and was rotated in the normal direction by the rotation of the charging roller 2*a*, the charging roller 2*a* was less contaminated with the deposited matter and thus the image defect was not caused to occur. In other cases, the contamination of the charging roller 2*a* with the deposited matter caused the charging non-uniformity and the image defect.

Also from this result, in order to enhance the cleaning performance for the charging roller 2*a,* it was confirmed that it was necessary to increase the rotational speed ratio of the brush roller 50 to the charging roller 2*a*. Further, for this purpose, the setting such that the rotational speed ratio is further increased by utilizing the brush roller 50 which has been subjected to the fiber-tilting treatment.

According to the constitution of Embodiment 2, without using the urging springs 33 and 34, the charging roller 2*a* is cleaned to remove the external additive therefrom by rotating the brush roller 50 by the rotation of the charging roller 2*a* similarly as in Embodiment 1. Further, the fiber penetration amount is set in advance so that the "relationship of the peripheral speed ratio of the brush roller 50 to the charging roller 2*a*" is ensured similarly as in Embodiment 1 to maximize the cleaning performance of the brush roller 50.

Finally, when the rotational speed ratio of the brush roller 50 to the charging roller 2*a* as the condition in which the above effect is obtained is studied in the same manner as in Embodiment 1, the degree of change in rotational (peripheral) speed ratio in the case of the straight fiber brush is small between those during the normal rotation and the reverse rotation. On the other hand, in the case of the tilted fiber brush, the degree of change between those during the normal rotation (FIG. 5(*a*)) and the reverse rotation (FIG. 5(*b*)) is $45/64 \approx 0.703$, i.e., 80% or less. Therefore, it has been confirmed that the image defect is not caused to occur under the condition that the ratio of the rotational speed ratio during the reverse rotation (FIG. 5(*b*)) to the rotational speed ratio during the normal rotation (FIG. 5(*a*)).

Embodiment 3

In Embodiments 1 and 2, the brush roller subjected to the heat treatment for tilting the straight fibers after the electrostatic fiber planting of the fibers in the straight fiber state was used. However, the method of preparing the brush roller in the tilted fiber state is not limited to the above method. For example, in the case where an adhesive is applied onto a metal cylinder and then the electrostatic fiber planting is performed while rotating the metal cylinder at a predetermined rotational speed, it is possible to raise the fibers from the cylinder surface with arbitrary tilting angle by adjusting the rotational speed of the metal cylinder.

That is, in a structure in which the brush roller 50 is rotated by receiving the driving force by the traction between the surface of the charging roller 2*a* and itself, the rotational speed of the brush roller 50 cannot be set at a predetermined value in some cases. That is because the "relationship of the peripheral speed ratio of the brush roller to the charging roller" is destroyed. In this case, the cleaning of the charging roller by the brush roller cannot be performed properly, thus leading to improper cleaning. This phenomenon is noticeable in the case where the length of the fibers is excessively long or the case where the flexibility of the fibers is small.

Also in Embodiment 3, similarly as in Embodiments 1 and 2, it is possible to properly effect the cleaning by bringing the rotational speed ratio of the rotatable cleaning member to the rotatable charging member nearer to 1. The rotatable cleaning member is pressed against the rotatable charging member, thus being rotated by the rotation of the rotatable charging member through the traction between the rotatable cleaning and charging members. Further, the rotatable cleaning member is rotated by the rotation of the rotatable charging member by keeping the distance between the rotatable cleaning member and the rotatable charging member at a value at which the traction is exerted during the rotation, so that the tilted fiber direction of the fibers is set so that the tips of fibers are directed counterdirectionally with the rotational direction of the rotatable cleaning member rotated by the rotation of the rotatable charging member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 086515/2009 filed Mar. 31, 2009 and 056887/2010 filed Mar. 15, 2010, which are hereby incorporated by reference.

What is claimed is:

1. A charging device comprising:

a rotatable charging member for electrically charging a photosensitive member; and a brush, rotating along a rotational direction of said charging member by contacting said charging member to receive a force, comprising fibers for cleaning said charging member, wherein the fibers have been subjected to fiber-tilting treatment so that the fibers are tilted in a direction counterdirectionally with a rotational direction of said brush.

2. A device according to claim 1, wherein said brush is set to have a diameter/length ratio of the fibers and a fiber penetration depth with respect to said charging member so that a contact pressure is created by bending elastic deformation of the fibers obliquely contacting the surface of said charging member through the fiber-tilting treatment.

3. A device according to claim 2, wherein a distance between a rotation shaft of said brush and a rotation shaft of said charging member is fixed.

4. A device according to claim 3, wherein the fibers are nylon fibers which have a circular cross-sectional shape, a diameter of 20 μm or more and 30 μm or less, a free length of 0.5 mm or more and 0.8 mm or less, and a fiber-planting density of 50,000 fibers/inch$^2$ or more and 600,000 fibers/inch$^2$ or less.

5. A device according to claim 1, wherein said brush has been subjected to the fiber-tilting treatment so that when said brush rotates by contacting said charging member rotating at a predetermined speed to receive the force, said brush has a peripheral speed at the time when the fibers of said brush are tilted in a direction codirectionally with the rotational direction of said brush is 80% or less of a peripheral speed thereof at the time when the fibers of said brush are tilted in the direction counterdirectionally with the rotational direction of said brush.

* * * * *